United States Patent [19]

Hammarberg

[11] 4,430,373

[45] Feb. 7, 1984

[54] REINFORCED BEAM SECTION AND A METHOD OF PRODUCING IT

[76] Inventor: Lars Hammarberg, Avant. Poste 3, CH-1005 Lausanne, Switzerland

[21] Appl. No.: 403,658

[22] PCT Filed: Dec. 7, 1981

[86] PCT No.: PCT/SE81/00357

§ 371 Date: Dec. 5, 1980

§ 102(e) Date: Jul. 30, 1982

[87] PCT Pub. No.: WO82/01906

PCT Pub. Date: Jun. 10, 1982

[30] Foreign Application Priority Data

Dec. 5, 1980 [SE] Sweden ..... 8008553

[51] Int. Cl.[3] ..... B32B 5/12

[52] U.S. Cl. ..... 428/113; 162/107; 264/277; 428/222; 428/326; 428/364; 428/369; 428/371; 428/537; 428/541

[58] Field of Search ..... 428/222, 228, 233, 239, 428/251, 268, 273, 257, 285, 297, 298, 438, 537, 541, 538, 702, 326, 105, 108, 109, 113, 364, 369, 370, 371; 162/104, 107, 108; 264/113, 241, 271, 277

[56] References Cited

U.S. PATENT DOCUMENTS

| | | | |
|---|---|---|---|
| 2,847,733 | 8/1958 | Roy | 428/222 |
| 3,890,077 | 6/1975 | Holman | 264/109 |
| 3,986,331 | 10/1976 | Brumlik | 428/371 |
| 4,020,202 | 4/1977 | Kreft | 428/371 |
| 4,091,153 | 5/1978 | Holman | 428/292 |
| 4,127,636 | 11/1978 | Flanders | 428/326 |
| 4,177,306 | 12/1979 | Schulz et al. | 428/113 |
| 4,379,798 | 4/1983 | Palmer et al. | 428/113 |
| 4,384,022 | 5/1983 | Fowler | 428/369 |

*Primary Examiner*—James J. Bell

*Attorney, Agent, or Firm*—Ostrolenk, Faber, Gerb & Soffen

[57] ABSTRACT

The invention relates to reinforced beam sections produced by forming the cross-sectional configuration of wood particle board, e.g. such as have been provided with bonded-in reinforcing threads (4,5,6,32,48) The latter have thereby been laid in the zones (33,34,45) of the boards where the beam section configuration changes direction during the formation of the beam. Beam sections in accordance with the invention will be light, corrosion-resistant and saving on material as well as having high breaking strength, due to the reinforcement. The field of use for such beam sections is very varied, but among more obvious uses may be mentioned those as beams in housing structures and different kinds of batten in the building trade. A method of laying the reinforcing threads in predetermined zones in the boards is also embraced by the invention.

5 Claims, 4 Drawing Figures

REINFORCED BEAM SECTION AND A METHOD OF PRODUCING IT

The present invention relates to a reinforced beam section and a method of producing it by means of compression moulding wood particle boards which are internally reinforced with glass fibre at least in zones.

The beam sections primarily envisaged for the application of the present invention are light building beam structures, e.g. with L, U, Z or V section. In the prior art, such beam sections are usually made from metal sheeting which is folded or stamped to the desired section configuration. Rolled or extruded aluminium sections are also available. Although such metal beam structures have satisfactory strength properties, they have certain disadvantages, e.g. sensitivity to corrosion and high thermal conductivity which may lead to so-called "cold bridges" when used, especially in respect of outer walls.

The increased use of light beam sections of metal within the building trade has been primarily brought about by the heavily increasing prices of solid, first-class timber which has up to now been the dominating material in wall beams, floor joists, battons etc. in house structures, for example. To avoid the avoid above-mentioned disadvantages with metal beam structures while holding weight and cost levels down, there have been trials made to produce simplified light beam structures in wood. As examples of such structures can be mentioned I-beams with a web fabricated from wood fibre board and fastened between two timber studs. There are also structures where two thin wood fibre board sheets have been proviede with an intermediate filling of foamed plastics or other insulation material and fixed along their edges against intermediate spacer battons. The machining and assembling operations required in the production of these composite timer beams reduce to a certain extent the material savings gain, thus increasing the cost which is to be compared with the cost of using solid joists or the like.

A basic concept in the realization of the present invention has been that compression moulding of light sheet metal structures in an appealing method of production in itself. If the sheet metal material could be replaced by wood particle material, much would be gained from the aspects of machining and use. In other words, a compression-moulded beam of wooden material should be cheap to manufacture, light and corrosion-resistant and thus be well-suited for use in structures where light building beams, joists and the like are used.

Compression moulding is already known per se in woodworking. Accordingly, such items as seat bottoms and trays are produced by compression moulding (providing the item with a particular configuration under pressure and heat) of plywood, laminated wood etc. Wood particule boards can in a similar way be processed by compression moulding. The problem in using this technique in the manufacture of beams from wood partiicle boards would lie primarily in obtaining required material strength in the finished beam. As opposed to board material and laminated products produced by compression moulding, beam section structures are subjected to very high concentrated loads and shearing loadings which are intended to be taken up and transmitted by means of a section configuration suited to each individual purpose. The basic idea hereby is that the different beam elements shall be put together so that the loading forces acting thereon will act substantially in the longitudinal direction of the beam member towards a point of flexure wherein the section merges at substantially a right angle into another beam member. As a result of the above-mentioned conditions, material stresses will be greatest in the angled zones of the beam section. These stresses will be of such a magnitude that a conventionally compression moulded beam of wood particle board would not resist the loadings prevailing, and would buckle for relatively modest bending and shearing loads, beginning in the angled zones of the section.

The production of a compression moulded beam section fabricated from wood particle board has now been enabled by means of the present invention. In accordance with the invention this has been enabled by the particle board being provided already during manufacture with embedded reinforcing strands of glass fibre which have been positioned in the zones of the borad where it has been formed by the compression moulding to form the beam secton.

The invention will now be described, while referring to the appended drawings, whereon:

Figure 1:
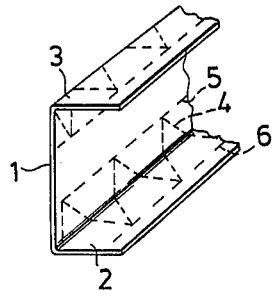
FIG. 1 illustrates a channel section in accordance with the invention.

In the channel illustrated in FIG. 1, reinforcing threads 4, 5, 6 have been laid in the zones between web 1 and flanges 2, 3. In this case the reinforcing threads are of glass fibre, one thread 4 being laid zigzag and two threads 5, 6 being laid straight in the direction of travel of the fibre mass during manufacture, the zigzag thread being suitably laid so that it surrounds the other two threads to form a rope ladder-like reinforcement. How the reinforcing threads are laid in the board is explained in conjunction with the description in connection with FIG. 4.

Figure 2:
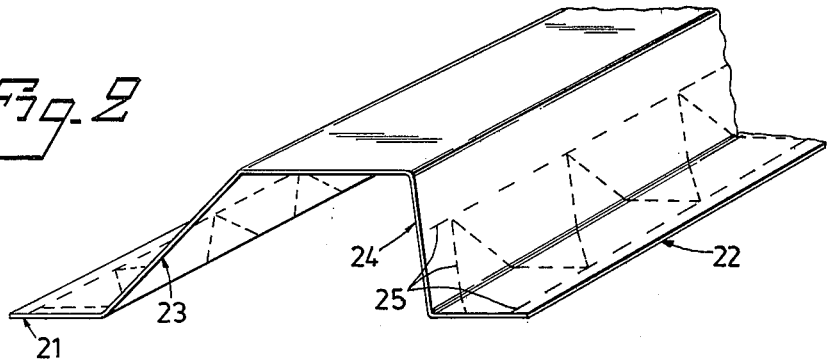
FIG. 2 illustrates a batten used in conjunction with roofing.

A batten in accordance with the invention is illustrated in FIG. 2 the profile of the batten being substantially similar to that of known metal sheet structures for the same purpose. In this case the loads are greatest at the angle between sides 23, 24 projecting away from the web and free flanges 21, 22 of the profile. Reinforcement 25 has therefore been arranged in the zones at the junctures of portions 21, 23 and 22, 24. In this case it has also been found suitable to reinforce the flanges themselves, these being used to attach the batten to a substructure by means of nailing or riveting. Consequently, the reinforcing zone has been arranged to cover the greater part of the flanges.

Figure 3:
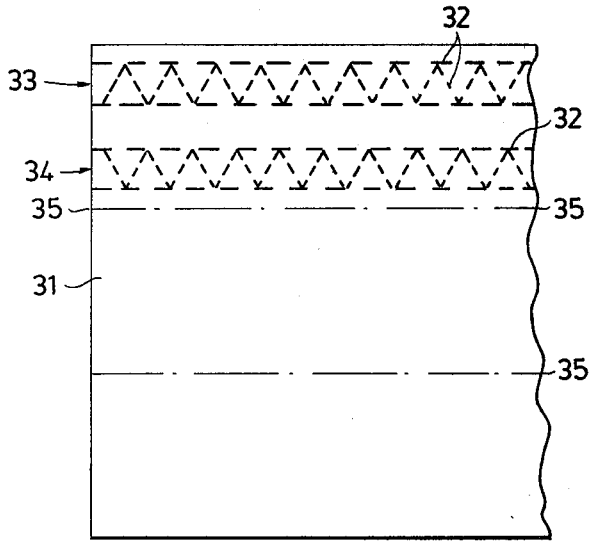
FIG. 3 illustrates a filament- or thread-reinforced wood particle board for manufacuring the batten in question, and FIG. 4 schematically illustrates a section of the production line where the invention is applied in the manufacture of wood particle boards.

Flat wood particle boards in which reinforcing threads of glass fibre have been provided in given zones during the manufacturing process of said boards are used, as previously mentioned, as the semi-finished product in manufacturing beam sections in accordance with the invention. Such a board for the manufacture of battens according to FIG. 2 is shown in FIG. 3. In this board 31 reinforcing threads 32 have been laid in zones 33, 34 within which the angle bend between the flange and the side outstanding from the web will be made during moulding the finished section. The boards are suitably manufactured with a width such that a plurality of batten blanks are obtained after longitudinal parting 35 of the boards.

Figure 4:
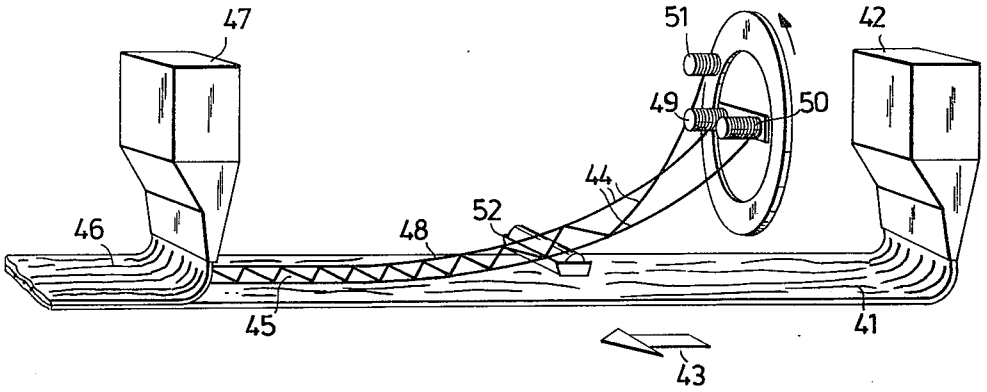

FIG. 4 schematically illustrates a suitable method of providing the inventive reinforcement during manufacture of the boards, as well as the equipment required. As one of the first operations in a continuous board manufacturing process, a wood particle mass for providing a bottom layer 41 of the board is supplied from a wood praticle stock vessel 42. The layer is advanced in the direction of the arrow 43 and reinforcing threads 44 are laid out on top of the bottom layer so that the reinforcement will cover a predetermined zone 45 on the board-to-be. In the next phase of this principally sketched continuous manufacturing process, a top wood particule layer 46 of the board is applied from a stock vessel 47. A suitable method of continuously forming a network 48 of reinforcing threads has been illustrated in the Figure by two stationary spools or bobbins 49,50 and a bobbin 51 arranged to circle round the bobbins 49,50. The preparation of the threads with an adhesive before laying on the bottom layer has been schematically illustrated by a vessel 52 containing the adhesive. Manufacturing equipment of the kind shown, when applied in an embodiment suitable for production, must of course be provided with a pluality of details and means, not shown here, for driving, advancing, guiding and controlling the different steps in the manufacturing operation. It is also assumed that in practical production it will be advantageous to arrange serveral parallel units for providing zonal reinforcement across the width of the board in each board manufacturing line. The other equipment required for board manufacture, such as dewatering, drying and hardening has not been shown in the Figure either.

A suitable type of reinforcing thread has been found to be a glass fibre thread of the so-called "rooving-type", the thread being formed by a bundle or cluster or glass fibre filaments with about 2000–4000 glass fibre fibrills with a thickness of 0.010–0.040 mm.

A suitable adhesive for use in preparing the reinforcing threads before they are laid in the wood particle mass is a polymer adhesive, e.g. water-emulsified polyvinyl acetate (PVA) glue with a water content of 40–60%. The application of a suitable adhesive to the threads has been found to be extremely important for obtaining a satisfactory bond between the reinforcing threads and the wood particle composition, as well as between the individual glass fibre filaments incorporated in the threads. With regard to the board production process, a water-based glue should be used, its viscosity being adjusted such that rapid impregnation of the thread, i.e. proper coating of the individual filaments, is obtained. However, the viscosity should not be so low as to risk too great seepage into the wood particle composition, and for this purpose a water content of the adhesive emulsion of about 40–60% has been found suitable.

I claim:

1. A reinforced beam section provided by forming, e.g. compression molding, a board-shaped semi-finished product, characterized in that said product is a wood pulp board known per se having reinforcing threads preferably of glass fiber embedded and bonded therein at least in predetermined zones, said zones are zones around areas of inflection, i.e. changes in direction in the configuration of the finished section and said reinforcing threads are in the form of continuously running threads, crossing over from one side to another of said inflection points in the configuration of the section in a plurality of places in the longitudinal direction of said inflection points.

2. A section as claimed in claim 1, characterized in that the reinforcing threads are glass fiber threads comprising bunches or clusters of glass fiber filaments having 2000–4000 filaments with a thickness of 0.010–0.040 mm.

3. A section as claimed in claim 1 or 2, characterized in that the threads are bonded in the material of the board with the aid of an adhesive comprising a water-based polymer glue.

4. A section as claimed in claim 3, characterized in that the adhesive is a polyvinyl acetate glue, adapted with a water content of 40–60% to impregnate the reinforcing threads, i.e. to coat the filaments of which the threads comprise.

5. A method of producing a reinforced beam section as claimed in claim 1, characterized in that the section is formed, e.g. by compression molding of wood pulp board known per se, which is provided in conjunction with its manufacture with embedded reinforcing threads, preferably from glass fiber, said threads being laid in predetermined zones in said boards and in continuously running threads crossing over from one side to another of said inflection points in the configuration of the section in a plurality of places in the longitudinal direction of said inflection points after the compression moulding and in said zones the inflection points of the beam section thereafter are provided during the process of forming the section.

* * * * *